United States Patent [19]

Osborne

[11] 4,252,267

[45] Feb. 24, 1981

[54] SELF LOCKING CONTAINER

[75] Inventor: Edward L. Osborne, Kansas City, Kans.

[73] Assignee: Westvaco Corporation, New York, N.Y.

[21] Appl. No.: 109,785

[22] Filed: Jan. 7, 1980

[51] Int. Cl.[3] ..... B65D 5/30; B65D 5/42

[52] U.S. Cl. ..... 229/33; 229/36; 229/45 R

[58] Field of Search ..... 229/36, 33, 45, 34 R

[56] References Cited

U.S. PATENT DOCUMENTS

| | | | |
|---|---|---|---|
| 690,498 | 1/1902 | Webb | 229/34 R |
| 1,559,237 | 10/1925 | Fox | 229/33 X |
| 1,755,722 | 4/1930 | Bachmann | 229/33 |
| 1,862,980 | 6/1932 | Prather et al. | 229/33 UX |
| 2,193,925 | 3/1940 | Huye | 229/45 UX |
| 2,373,977 | 4/1945 | Scherer | 229/45 X |
| 2,663,488 | 12/1953 | Gibbons | 229/36 |
| 2,789,750 | 4/1957 | Kramer | 229/36 |
| 2,889,103 | 6/1959 | Kuchembecker | 229/45 |
| 3,093,291 | 6/1963 | Brandle | 229/45 X |
| 3,684,159 | 8/1972 | Wolfe | 229/45 |
| 3,827,624 | 8/1974 | Dogliotti | 229/45 |

FOREIGN PATENT DOCUMENTS

| | | | |
|---|---|---|---|
| 17643 | 1/1935 | Australia | 229/35 |

*Primary Examiner*—Davis T. Moorhead

[57] ABSTRACT

The invention relates to a self locking container comprising an integral tray and cover. Both the tray and cover are assembled without adhesive by tab and slot combinations provided in the walls thereof. In addition, the tab and slot combination for securing and locking the cover portion also serves as an automatic locking device for locking the cover to the tray when the container is closed.

4 Claims, 4 Drawing Figures

SELF LOCKING CONTAINER

BACKGROUND OF INVENTION

The present invention is directed to a self locking container, or one which is assembled without the use of adhesives. More particularly, the present invention relates to a container comprising an integral tray and cover wherein the self locking means for assembling the container also serves to provide an automatic locking feature between the tray and cover when the container is closed.

Not all containers with hinged covers are provided with means for holding the cover in a closed position since other means such as overwraps, straps and the like are often used. In those containers which do have integral cover locking means, the locking means generally takes the form of a flap or the like attached to or integral with the cover for effecting the purpose. U.S. Pat. No. 3,827,624 illustrates one form of a closure arrangement for a container having a hinged lid wherein the locking means comprises a flap attached to one edge of the lid. In addition, U.S. Pat. No. 2,889,103 shows yet another means for locking a cover to a tray in the closed condition. However, in the latter patent, the tray and cover must be pre-glued and the locking means is not automatically effected upon closing the cover since some manual adjustment must be made. Meanwhile, U.S. Pat. No. 3,684,159 shows a container with an integral lid and a locking means which is more-or-less automatic. However, in the last mentioned disclosure the cover portion must be pre-glued and the locking mechanism is not very substantial. Thus, while containers of the class described herein are known, there is no teaching in the art to show an unglued container wherein the means assembling the container also serves the dual purpose of providing a self locking means for automatically locking the cover to the tray when the container is closed.

Accordingly it is an object of the present invention to provide a self locking container to compete with infold and outfold machine glued containers.

Another object is to provide a self locking container with a cover that locks automatically when closed.

Still another object is to provide a self locking container that can be shipped and stored in flat condition but which can be readily erected for use either manually or with available carton erecting machinery.

A further object of the present invention is to provide a convenient container for packaging meat products, small manufactured parts and for gifts or the like.

SUMMARY OF INVENTION

According to the present invention, there is provided a container prepared from a single blank of paperboard or the like comprising a tray portion and an integral hinged cover. The hinged cover is foldably attached to the rear wall of the tray and both the tray and the cover portions are formed and locked together without the use of adhesives, staples or the like. In addition, the means for locking the cover together also serves a dual purpose by providing an automatic locking feature when the container is closed.

For the above purposes, a single blank of corrugated paperboard is scored and cut to provide a tray portion and a cover portion. The tray portion consists of a bottom panel with upstanding front, rear and opposed side walls. In addition, the tray portion includes corner closing flaps foldably attached to the ends of the front and rear walls. The corner closing flaps also include integral tab elements which are inserted through slots provided therefor in the tray side walls where they become locked in slits located in the bottom panel. Finally, the front wall of the tray portion also includes a pair of cover locking slots which are used to perform the automatic cover locking feature mentioned hereinbefore.

Meanwhile, the cover portion consists of a top panel with a front and opposed side walls. In addition, the cover portion includes a pair of corner closing flaps foldably attached to its opposed side walls adjacent to the front wall. The corner closing flaps of the cover portion also include integral tab elements which serve a dual purpose, i.e., they are used to fasten and secure the opposed side walls of the cover to the front wall and also serve as the tab elements for performing the automatic cover locking function. For this purpose, the cover portion tab elements are inserted through slots provided therefore in the front wall where they then become available for automatically engaging the cover locking slots provided in the tray front wall when the container is filled and the cover is closed. In order for the invention to perform as described, the various panels, walls, tabs and slots are sized so that the cover walls snugly overlie the corresponding tray walls then the container is closed.

DETAILED DESCRIPTION

Figure 1:
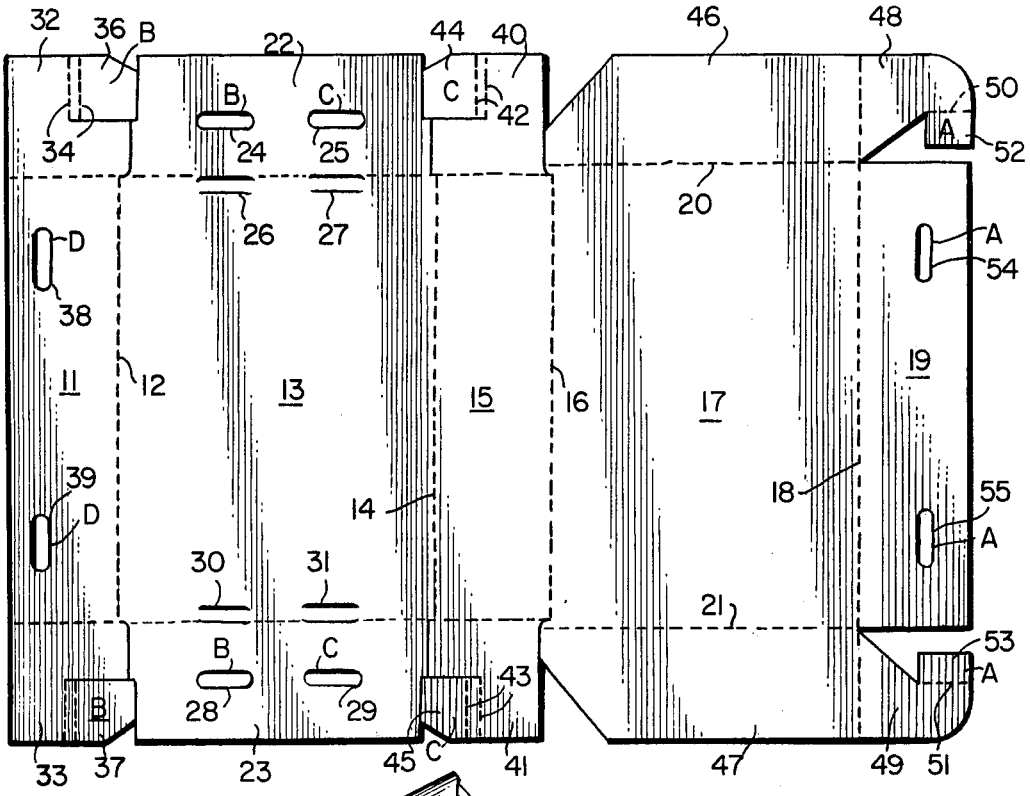
FIG. 1 is a plan view showing a typical blank structure for forming the container of the present invention.

Referring to the drawing, the container as illustrated is prepared from a single blank of corrugated paperboard or the like, suitably cut and scored as shown in FIG. 1. As designed, the container comprises an integrally connected cover and tray. The tray consists of a bottom panel 13, a front wall 11 foldably connected thereto along a score line 12, a rear wall 15 foldably connected thereto along a score line 14 and a pair of opposed side walls 22 and 23 foldably connected to the bottom panel 13 along the score lines 20 and 21. The tray portion also includes a plurality of corner connecting panels 32,33 and 40,41 foldably connected to the front and rear walls 11 and 15 along the score lines 20,21. Meanwhile, the tray side walls include locking slots 24,25 and 28,29 which are used to secure and retain the tray portion together. For this purpose, the corner connecting flaps 32,33 and 40,41 each include integral tab elements 36,37 and 40,41. These tab elements are foldably connected to the corner panels along divided fold lines 34,35 and 42,43. In addition, the tray portion bottom panel 13 includes locking slits 26,27 and 30,31 for capturing and retaining the ends of the tabs 36,37 and 40,41. Thus, the tray portion is set up by squaring the front 11, rear 15 and opposed side walls 22,23 around the bottom panel 13 so that the corner connecting flaps 32,33 and 40,41 lie outside the side walls 22,23. At that point, the tab elements 36 and 40 are inserted through the slots 24,25 provided therefor in the side wall 22 where the ends thereof become engaged in the slits 26,27. Meanwhile, at the opposite side of the tray, the tab elements 37 and 45 are inserted through the slots 28,29 provided therefor in side wall 23 where the ends thereof become engaged in the slits 30,31. In this manner, a completely set up tray is constructed without the aid of adhesives, staples or the like. The method of construction just described is particularly important when meat or meat products are being packaged because adhesives, staples or the like may provide contamination to the packaged products.

The cover portion consists of a top panel 17, a front wall 19 foldably connected thereto along a score line 18 and a pair of opposed side walls 46,47 foldably connected to the top panel 17 along the score lines 20,21. The cover portion also includes a pair of corner connecting flaps 48,49 foldably connected to the ends of the side walls 46,47 adjacent to the front wall 19. Also, the front wall 19 includes a pair of locking slots 54,55 which are used to secure and retain the cover portion together. For this purpose, the corner connecting flaps 48,49 each include integral tab elements 52,53 foldably attached thereto along fold lines 50,51.

After the tray portion is constructed as set forth hereinbefore, the cover portion is fashioned as follows. The front 19 and the side walls 46,47 of the cover portion are squared around the top panel 17 so that the corner connecting flaps 48 and 49 lie outside the front wall 19. At that point, the tab elements 52,53 are inserted through the slots 54,55 provided therefor in the front wall 19 where the ends thereof then become available as an automatic cover locking mechanism after the container is filled and closed.

Figure 2:
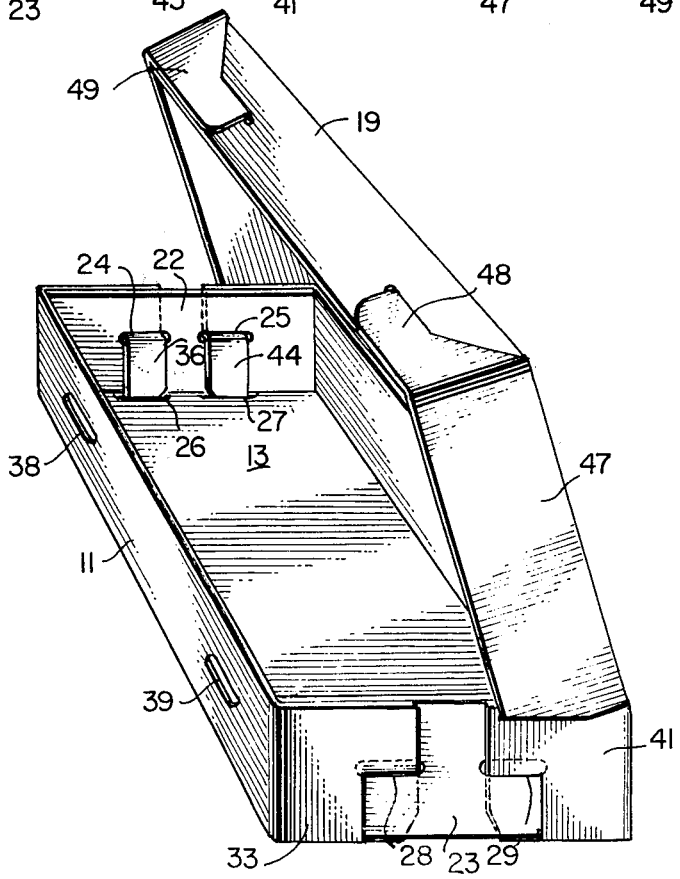
FIG. 2 is a perspective view of the container formed from the blank of FIG. 1 with the cover portion open.
Figure 3:
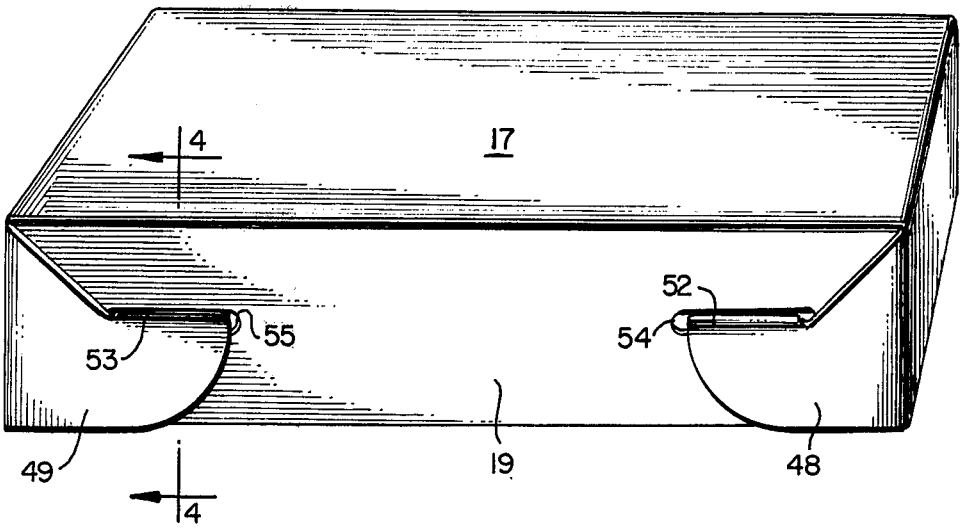
FIG. 3 is a perspective view of the container of FIG. 2 with the cover portion closed and locked.
Figure 4:
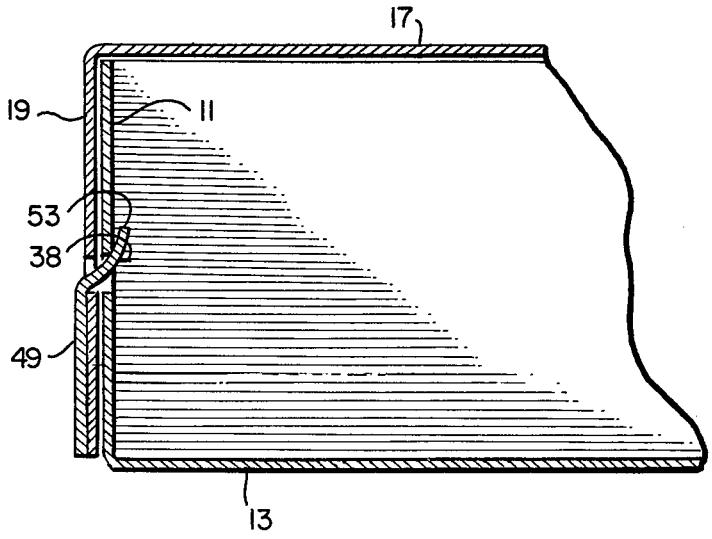
FIG. 4 is a partial section taken along the lines 4—4 of FIG. 3 showing the automatic locking feature.

In use, the container, whether formed by hand or by suitably machinery provided for that purpose, is filled as desired. The condition of the container for filling is shown in FIG. 2. After being filled, the cover portion is simply closed, where because of the snug fit of the cover walls around the tray walls, the ends of the tab elements 52,53 become automatically engaged within the slots 38,39 provided in the tray front wall 11. The closed condition of the container is illustrated in FIG. 3 while a detail of the automatic locking feature is shown in FIG. 4. The container is subsequently opened by lifting the cover front wall 19 while simultaneously pressing the tray front wall 11 inwardly to disengage the tabs 52,53 from the slots 54,55.

It will thus be seen that the present invention provides an automatic locking means for hinged container covers wherein the container is set up for use without the aid of adhesive, staples or the like. The latter feature is particularly important for containers used in the meat packaging industry where contamination of the packaged products must be avoided at all costs. Also, a significant and important feature of the present invention resides in the provision of a single means, i.e., tabs 52,53, for securing the cover together and for providing the automatic locking feature.

From the foregoing, it is believed that the invention may be readily understood by those skilled in the art, it being apparent that changes may be made in the specific embodiment disclosed without departing from the spirit of the invention as defined in the appended claims.

I claim:

1. A self locking container prepared from a single blank of paperboard or the like comprising a tray portion and an integral cover portion, said tray portion including a bottom panel with upstanding front, rear and first opposed side walls foldably attached thereto, said front and rear walls further including a plurality of corner connecting panels foldably attached to the ends thereof, and said cover portion including a top panel with a front and second opposed side walls foldably attached to the outer edges thereof, said second opposed side walls further including a pair of corner connecting flaps foldably attached thereto adjacent the front wall, the improvement wherein the front, rear and first opposed side walls of the tray portion are locked and secured together without adhesive by a first tab and slot combination provided between the first opposed side walls and the corner flaps attached to the front and rear walls, and the front and second opposed side walls of the cover portion are locked and secured together without adhesive by a second tab and slot combination provided between the front wall and the corner flaps attached to the second opposed side walls, the tab elements of said second tab and slot combination further providing an automatic locking feature between the tray portion and the cover portion when the container is closed.

2. The container of claim 1 wherein the automatic locking feature is accomplished when the tab elements of said second tab and slot combination engage slots provided therefor in the front wall of said tray portion.

3. The container of claim 2 wherein the tab elements of said first tab and slot combination are inserted through the slots located in said first opposed side walls wherein the ends thereof become engaged in slits provided therefor in the tray bottom panel.

4. The container of claim 3 wherein the tab elements of said second tab and slot combination are inserted through the slots located in the front wall of said cover portion to lie inside thereof where they are available to automatically engage the slots provided in the front wall of said tray portion when the container is closed.

* * * * *